US008579157B2

(12) United States Patent
Bem et al.

(10) Patent No.: US 8,579,157 B2
(45) Date of Patent: Nov. 12, 2013

(54) AUTOMATED FLUID DISPENSER

(75) Inventors: Branko Bem, Plano, TX (US); Dikran Babikian, Glendale, CA (US); Robert A. Riccomini, Saratoga, CA (US); Amelia Ngai, Mountain View, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 806 days.

(21) Appl. No.: 12/605,258

(22) Filed: Oct. 23, 2009

(65) Prior Publication Data

US 2010/0213208 A1 Aug. 26, 2010

Related U.S. Application Data

(60) Provisional application No. 61/108,318, filed on Oct. 24, 2008.

(51) Int. Cl.
*B67D 1/00* (2006.01)

(52) U.S. Cl.
USPC ..... 222/63; 222/52; 222/173; 222/180; 222/333; 222/385; 222/566; 141/18

(58) Field of Classification Search
USPC ..... 222/52, 63, 333, 180, 321.7, 504, 222/321.9, 385, 566–568, 173; 4/623; 141/2, 18
See application file for complete search history.

(56) References Cited

U.S. PATENT DOCUMENTS

| | | | | |
|---|---|---|---|---|
| 4,735,345 | A | 4/1988 | Lee | |
| 4,938,384 | A * | 7/1990 | Pilolla et al. | 222/52 |
| 5,549,227 | A * | 8/1996 | Klotz | 222/461 |
| 5,632,414 | A * | 5/1997 | Merriweather, Jr. | 222/52 |
| 5,911,345 | A * | 6/1999 | Castleberry | 222/482 |
| 5,988,440 | A * | 11/1999 | Saunders et al. | 222/63 |
| 5,992,698 | A | 11/1999 | Copeland et al. | |
| 6,276,565 | B1 * | 8/2001 | Parsons et al. | 222/52 |
| 6,345,738 | B1 * | 2/2002 | Brozell et al. | 222/383.1 |
| 6,467,651 | B1 * | 10/2002 | Muderlak et al. | 222/52 |
| 6,863,093 | B2 * | 3/2005 | Garcia et al. | 141/2 |
| 7,025,227 | B2 * | 4/2006 | Oliver et al. | 222/61 |
| 7,198,175 | B2 * | 4/2007 | Ophardt | 222/188 |
| 7,527,174 | B2 * | 5/2009 | Meehan et al. | 222/180 |
| 8,100,299 | B2 * | 1/2012 | Phelps et al. | 222/180 |
| 2002/0053577 | A1 * | 5/2002 | Maas et al. | 222/383.1 |
| 2004/0211000 | A1 | 10/2004 | Buonocore | |
| 2005/0155988 | A1 * | 7/2005 | Meehan et al. | 222/321.7 |
| 2007/0000941 | A1 * | 1/2007 | Hadden et al. | 222/52 |

FOREIGN PATENT DOCUMENTS

| | | | |
|---|---|---|---|
| DE | 196 28 172 | A1 | 2/1997 |
| WO | WO 2004/110234 | A2 | 12/2004 |

OTHER PUBLICATIONS

Bobrick Washroom Equipment, Inc.; LABEL (Dispensing Filling Instructions); Jun. 19, 1999; 1 Page.

(Continued)

*Primary Examiner* — Frederick C Nicolas
(74) *Attorney, Agent, or Firm* — Christie, Parker & Hale, LLP

(57) ABSTRACT

A fluid dispenser is provided. The dispenser includes a reservoir for storing the fluid to be dispensed, an outlet for dispensing the fluid, a pump in the reservoir for pumping the fluid to the outlet, a motor external of the reservoir, and a coupling magnetically transferring a force generated by the motor to the pump for operating the pump for pumping the fluid.

47 Claims, 4 Drawing Sheets

(56) References Cited

OTHER PUBLICATIONS

International Preliminary Report on Patentability and Written Opinion of the International Searching Authority dated Apr. 26, 2011, for International Application No. PCT/US2009/061946, Filed Oct. 23, 2009.

Communication Relating to the Results of the Partial International Search dated Mar. 18, 2010, for PCT Application No. PCT/US2009/061946, Filed Oct. 23, 2009.

Bobrick Washroom Equipment, Inc.; *Instructions for Installation and Maintenance*; Instruction Manual; 2008; 2 pages; USA.

* cited by examiner

AUTOMATED FLUID DISPENSER

CROSS-REFERENCE TO RELATED APPLICATION

This application is based upon and claims the benefit of U.S. Provisional Application Ser. No. 61/108,318, filed on Oct. 24, 2008, the contents of which are fully incorporated herein by reference.

BACKGROUND OF THE INVENTION

Currently available automated liquid soap dispensers can deliver liquid soap automatically in response to the presence of a nearby object, such as a user's hand. These liquid soap dispensers typically employ an infrared sensor to detect the nearby object. Upon detection of the nearby object, the infrared sensor sends a signal to activate a motor, which in turn drives a shaft which drives a pump. The pump pumps the liquid soap to a spout of the dispenser which dispenses the soap. Typically, the motor is located outside of the dispenser, whereas, the pump is submerged in the liquid soap within the dispenser. The drive shaft penetrates the dispenser through an orifice typically at the base of the dispenser. A seal is typically provided surrounding the shaft and sealing the orifice. However, with use the seal wears out and the liquid soap leaks out of the dispenser. Often, the liquid soap leaks onto the motor or the motor circuitry causing failure of the motor.

Furthermore, most liquid dispensers have reservoirs which are mounted below a countertop. Consequently, accessing of the reservoir for refilling with liquid soap is inconvenient. Typically a reservoir of the soap dispenser needs to be removed from below the counter so that it may be filled. When removed, tubing which is used to deliver the liquid soap to the spout is exposed and liquid soap on such tubing drips on the surrounding surfaces. Moreover, with some soap dispenser, the motor may have to be removed before the reservoir is removed for refilling. Thus, a soap dispenser is desired that overcomes the aforementioned problems.

SUMMARY OF THE INVENTION

In an exemplary embodiment, a fluid dispenser is provided. The dispenser includes a reservoir for storing the fluid to be dispensed, an outlet for dispensing the fluid, a pump in the reservoir for pumping the fluid to the outlet, a motor external of the reservoir, and a coupling magnetically transferring a force generated by the motor to the pump for operating the pump for pumping the fluid. In another exemplary embodiment, the coupling includes a first member external of the dispenser driven by the motor, and a second member in the dispenser for driving the pump, where the first member is magnetically coupled to the second member, whereby the first member drives the second member. In yet another exemplary embodiment, at least one of the first and second members includes a magnet. In a further exemplary embodiment, the pump is submerged in the fluid to be pumped. In yet a further exemplary embodiment, the reservoir includes a body and a base portion, and the base portion is threaded or otherwise coupled to the body and the first and second members sandwich at least a portion of the base portion. In another exemplary embodiment, the dispenser also includes a sensor proximate the outlet for sensing movement proximate the outlet and for generating a signal in response thereto such that the pump pumps fluid in response to the signal. The motor, in an exemplary embodiment, is operable in response to the signal. In another exemplary embodiment, the dispenser also includes a neck extending from the reservoir defining a conduit in communication with the reservoir, a spout extending from the neck, and a lid on the spout being moveable for providing access to the conduit. The reservoir is finable through the conduit and the outlet is formed on the spout. A funnel coupled to the conduit may be included in the spout. In yet a further exemplary embodiment, the dispenser may also include a neck having a threaded outer surface, and a cap threaded, or otherwise coupled, to the reservoir neck and coupling the neck to the reservoir. In yet a further exemplary embodiment, a lock nut is also provided and is threaded on the outer surface of the neck. The cap includes a first surface and a second annular surface extending from the first surface. An opening is formed through the first surface, and the neck penetrates the opening and the first surface urges the lock nut toward the reservoir. In another exemplary embodiment, the dispenser may also include a neck extending from the reservoir having a threaded outer surface, a groove formed along the neck, a spout extending from the neck such that the outlet is formed on the spout, a first conduit coupled to the pump, a second conduit extending to the outlet, such that at least part of the second conduit is received in the groove, a conduit connector coupled to the neck and releasably connecting the first conduit to the second conduit, a first nut threaded on the outer surface of the neck and surrounding the portion of the second conduit received in the groove, a cap having an opening penetrated by the neck and threaded, or otherwise coupled, to the reservoir, such that the cap is retained in an axial direction by the first nut, and a second nut threaded on the outer surface of the neck and surrounding the portion of the second conduit received in the groove.

In another exemplary embodiment, a fluid dispenser is provided including a reservoir, a neck extending from the reservoir having a threaded outer surface, a groove formed along the neck, a spout extending from the neck, such that the outlet is on the spout, a pump for pumping fluid from the reservoir to the outlet, a first conduit coupled to the pump, a second conduit extending to the outlet, such that at least part of the second conduit is received in the groove, a conduit connector coupled to the neck and releasably connecting the first conduit to the second conduit, a first nut threaded on the outer surface of the neck and surrounding the portion of the second conduit received in the groove, a cap having an opening penetrated by the neck and threaded, or otherwise coupled, to the reservoir, where the cap is retained in an axial direction by the first nut, and a second nut threaded on the outer surface of the neck and surrounding the portion of the second conduit received in the groove. In yet another exemplary embodiment, a third conduit is defined through the neck, and the dispenser further includes a lid on the spout providing access to the third conduit for refilling the reservoir. In another exemplary embodiment, the dispenser also includes a funnel in the spout and coupled to the third conduit, such that the lid provides access to the funnel for refilling the reservoir through the conduit.

In yet a further exemplary embodiment, a fluid dispenser is provided having a reservoir, a neck extending from the reservoir defining a conduit there-through leading to the reservoir, a spout extending from the neck, where an outlet is formed on the spout, and a lid on the spout being moveable for providing access to the conduit for refilling the reservoir with a fluid. In another exemplary embodiment, the dispenser also includes a funnel in the spout and coupled to the conduit, such that the lid provides access to the funnel for refilling the reservoir.

In any of the aforementioned exemplary embodiments the fluid is a liquid, such as a liquid soap.

BRIEF DESCRIPTION OF THE DRAWINGS

The accompanying drawings, together with the specification, illustrate exemplary embodiments of the present invention and, together with the description, serve to explain the principles of the present invention.

DETAILED DESCRIPTION

In the following detailed description, only certain exemplary embodiments of the present invention are shown and described by way of illustration. As those skilled in the art would recognize, the invention may be embodied in many different forms and should not be construed as being limited to the embodiments set forth herein. Moreover, it should be noted that the terms "upper," "top," "bottom," and "lower" as used herein are terms used to denote the relative position of objects and not necessarily the exact position of such objects. For example, a "lower" object may in certain situations be located above an "upper" object.

Figure 1:
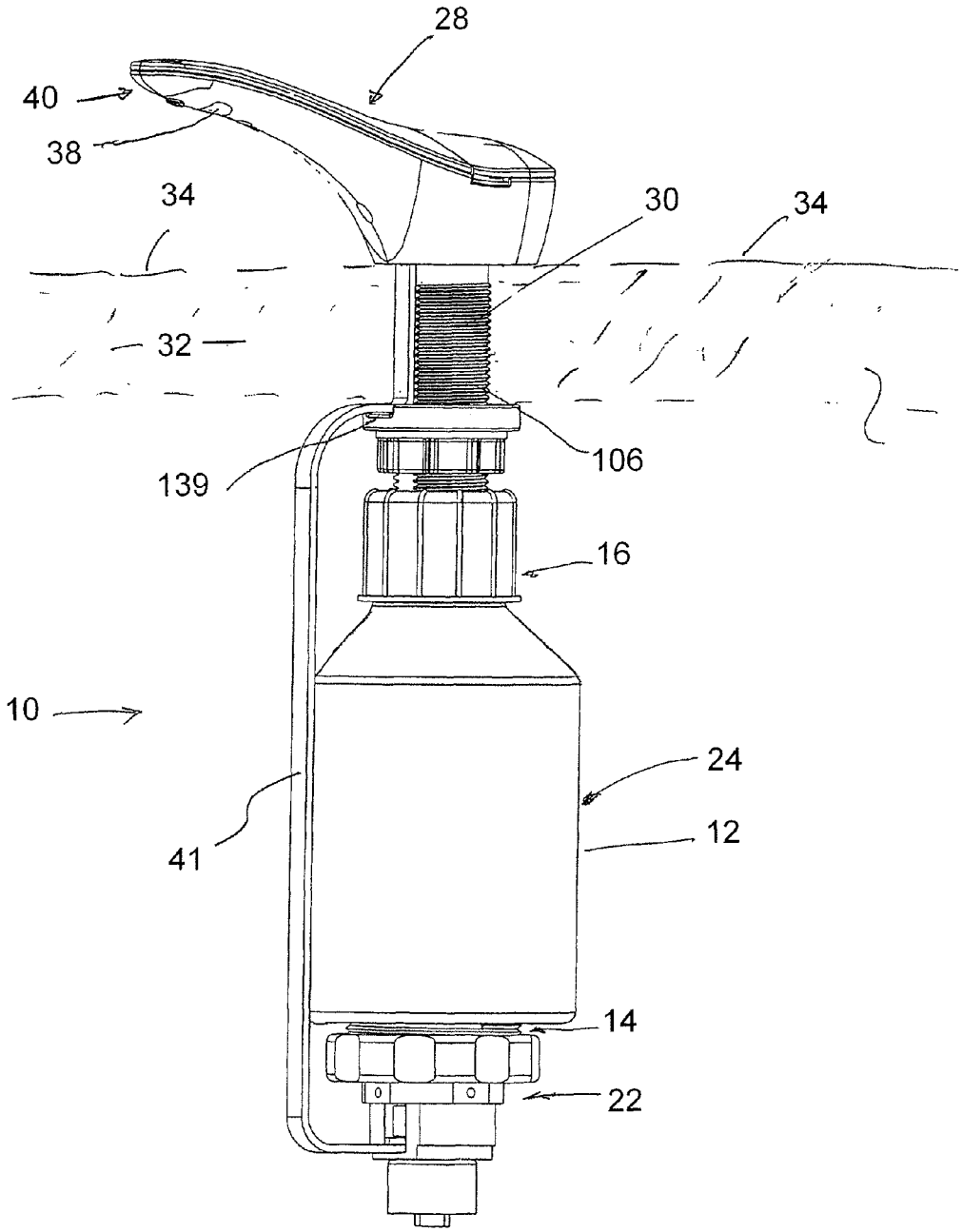
FIG. 1 is a plan view of an automated fluid dispenser according to an exemplary embodiment of the present invention.
Figure 2:
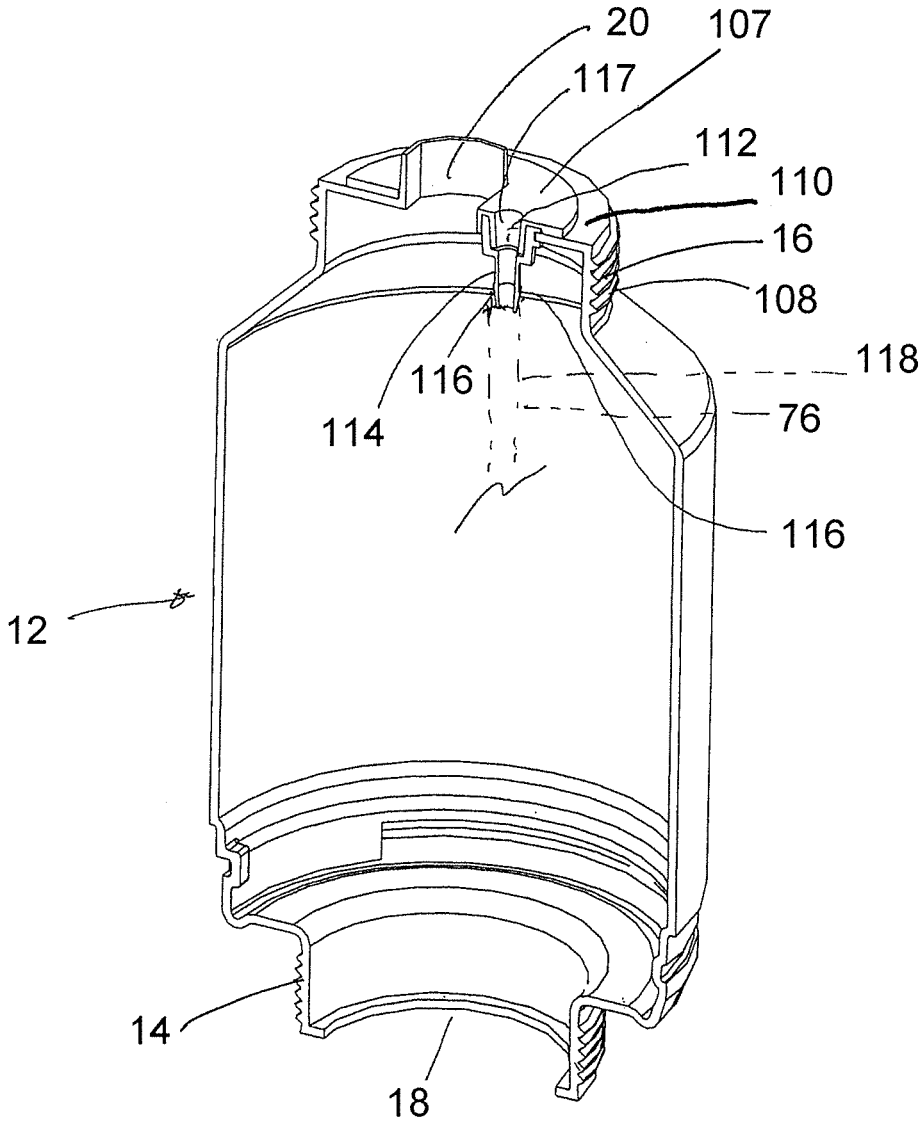
FIG. 2 is a partial cross-sectional view of reservoir body of the exemplary embodiment automated fluid dispenser shown in FIG. 1.
Figure 3:
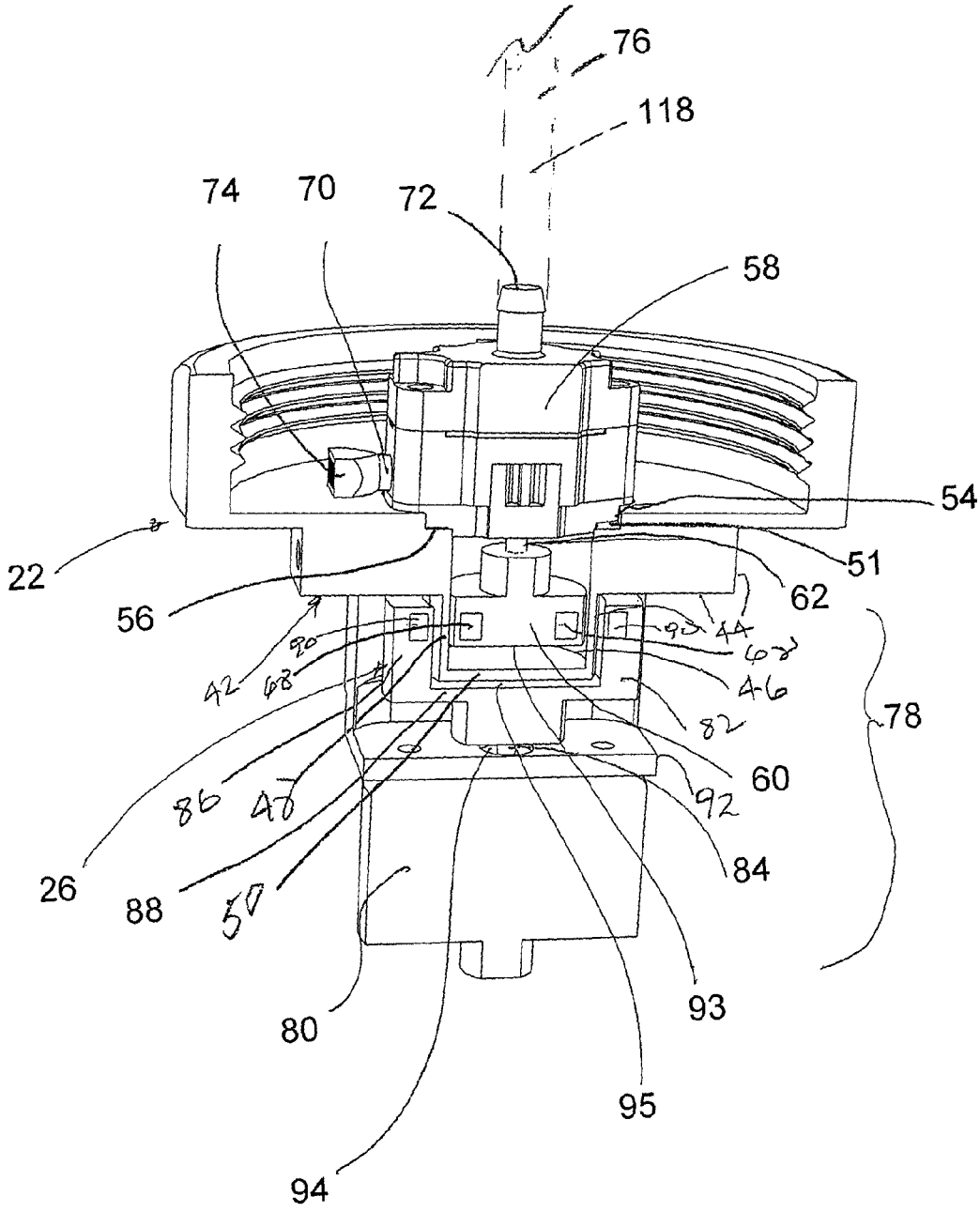
FIG. 3 is a partial cross-sectional view showing a base portion and a pump assembly of the exemplary embodiment automated fluid dispenser shown in FIG. 1.

With reference to FIGS. 1 and 2, an automated fluid dispenser 10 such as a liquid soap dispenser according to an exemplary embodiment of the present invention is shown. The automated liquid dispenser 10 has a reservoir body 12 having a base end section 14 and a neck section 16 opposite the base end section. In the shown exemplary embodiment, an opening 18, 20 is defined by each of the base and neck end sections, respectively. A base portion 22 is threaded to the base section 14 to define the base of the reservoir (FIG. 3). In other exemplary embodiments, the base portion 24 may be removably coupled to the base section using other means, as for example latches. The reservoir body 12 and the base portion 22 together define a reservoir 24. A pump assembly 26 is adjacent to the base portion 22. A housing (not shown) may be coupled to the reservoir 24 and surrounds the base portion 22 and pump assembly 26. The reservoir body 12 is connected to a spout 28 via a neck 30. When properly installed on a countertop 32, only the spout 28 and possibly an upper portion of the neck extend above an upper surface 34 of the countertop. The remaining portion of the neck, the reservoir, the base portion and the pump assembly remain below the upper surface of the countertop. A sensor, and in an exemplary embodiment, an infrared (IR) sensor 36 is housed in a portion of the spout 28. In an exemplary embodiment, the sensor is positioned behind or adjacent to a window 38 so that it can be protected from the outside elements, as best seen in FIG. 3. In an exemplary embodiment, the window is a non-plated surface that the sensor can sense through. When a user places his or her hand under a tip portion 40 of the spout 28, it is sensed through the window 38 by the sensor 36. In response, the sensor generates a signal which is transmitted via wiring or a circuit such as a flexible circuit 41 (FIG. 1), or in some embodiments wirelessly, to the pump assembly 26, or to a printed circuit board or other controller (not shown) to activate a pump of the pump assembly for liquid soap through a spout outlet 27.

In the shown exemplary embodiment, the base portion 22 has a bottom wall 42 which has a tiered outer surface 44. A depression 46 is defined in the bottom wall and has a circumferential wall 48 and a base wall 50. The circumferential wall 48 and the base wall 50 of the depression 46 define a tier of the bottom wall tiered outer surface 44. A second depression 51 defined by a wall 54 having a dimension greater than a diameter of the depression 46 is defined on the bottom wall above the depression 46. As a result, a shoulder 56 is defined between the two depressions 46, 51.

The pump assembly 26 includes a pump 58, and a pump coupler 60 that is connected to the pump 26 by a pump shaft 62, as shown in FIG. 3. Rotation of the pump coupler rotates the shaft which in turns rotates and causes the pump to pump. In an exemplary embodiment, the coupler is a disc shaped member. Magnets 68 are incorporated in the coupler 60 at circumferentially spaced apart locations around the circumference of the pump coupler. In another exemplary embodiment, the coupler itself or any portion thereof may be made from a magnetic material. The pump 58 is seated on the shoulder 56 within the depression 51 formed on the bottom wall of the base portion. In an exemplary embodiment, the depression 51 has a shape complementary to the outer shape of the pump portion that is received within the depression. Such portion may merely be a section extending from the pump. The wall 54 defining the depression 51 serves to restrain the pump from rotating when the pump shaft 62 is rotated. When the pump is seated on the shoulder 54, the coupler 60 is suspended in the depression 46. In another exemplary embodiment, the coupler may be seated on the base wall 50 of the depression 46.

In another exemplary embodiment, the pump 58 may be fastened to the base portion with the pump coupler extending into the depression 46. With such an embodiment, the second depression 51 may not be necessary. The pump may be a gear pump, a piston pump or a peristaltic pump or any type of pump. In the exemplary embodiment, the pump is accommodated in the reservoir and is submerged in the liquid soap which it will pump. In the shown exemplary embodiment, the pump includes an inlet 70 and an outlet 72. A filter 74 is coupled to the inlet to prevent debris suspended in the liquid to be pumped from entering the pump. Tubing 76 is provided extending from the pump outlet to the spout outlet 27 for delivering the pumped liquid from the pump to the spout outlet. In another exemplary embodiment, the tubing may be composed of multiple tubing sections.

The pump assembly also includes a motor subassembly 78 which includes a motor 80 and a motor coupler 82 coupled to the motor via a motor shaft 84. The motor drives the motor coupler 82 via the motor shaft 84. In the shown exemplary embodiment, the motor coupler includes a tubular portion 86 extending from a base portion 88. Magnets 90 are mounted at locations circumferentially around the tubular portion. In another exemplary embodiment, the motor coupler, or any portion thereof, may be formed from a magnetic material. The magnets 90 or magnetic material are chosen such that they attract the magnets 68 or magnetic material on the pump coupler 60. The motor coupler tubular portion has an inner surface diameter that is slightly larger than an outer surface diameter of the wall 48 defining the depression 46. The motor shaft 84 is coupled to the base portion 88 of the motor coupler 82 and rotates the motor coupler about a central longitudinal axis of the tubular portion 86.

The motor subassembly 78 is coupled to the reservoir 24 such that the tubular portion 86 of the motor coupler surrounds the circumferential wall 48 of the depression 46. The motor subassembly may be connected to the reservoir by any method. For example, the motor may be fastened to a housing 92 which is attached to the base portion 22 of the reservoir. The housing houses the motor coupler 82 and may be threaded, fastened or otherwise attached to the base portion 22 of the reservoir. An opening 94 allows the motor shaft 84 of the motor 80 located external of the housing 92 to penetrate the housing for driving the motor coupler 82. In an exemplary embodiment, the connection between the motor subassembly and the reservoir is such that it allows for the easy removal of the motor or motor subassembly for replacement or servicing.

When properly mounted to the reservoir, the magnets 90 on the motor coupler magnetically attract the magnets 68 on the pump coupler, which pump coupler is separated from the motor coupler by the walls 48 and 50 defining depression 46, such that rotation of the motor coupler causes rotation of the pump coupler. As a result, as the motor rotates the motor coupler, the motor coupler causes the pump coupler to rotate which in turn causes the pump to pump out the liquid within the reservoir through the pump outlet 72. As can be seen, the pump is coupled and driven by the motor via the magnets in the motor coupler and the pump coupler which sandwich the base portion of the reservoir. The thickness of the circumferential wall 48 of the depression 46 in the base portion is chosen such that the magnets on the motor coupler and the magnets on the pump coupler are capable of attracting each other through the circumferential wall with sufficient force such that they are magnetically coupled together such that rotation of the motor coupler will cause rotation of the pump coupler. The rotational energy of the motor is transferred magnetically through the base of the base portion 22 that is coupled to the reservoir without requiring any openings through the base portion, and thus, potential leak forming sites through the reservoir base.

In an exemplary embodiment, at least a magnet is incorporated into one of the pumps and motor couplers while at least a metal piece is incorporated in the other of the pumps and motor couplers which is attracted by the magnet. The magnet and metal piece may be arranged circumferentially around their respective coupler. When multiple magnets and metal pieces are used, the magnets and metal pieces are arranged around their respective coupler such that each magnet is radially alignable with a corresponding metal piece. In yet another exemplary embodiment, each coupler may include magnets and metal pieces such that a magnet of the pump coupler is radially alignable with a metal piece of the motor coupler and a magnet of the motor coupler is radially alignable with a metal piece incorporated on the pump coupler. In other exemplary embodiment, each coupler may include a single magnet and/or metal piece. In an exemplary embodiment, a single magnet which is ring-shaped may be used as part of either the pump coupler and/or the motor coupler. The magnets and/or metal pieces may be mounted in depressions formed on the couplers or may be embedded in the couplers. In another exemplary embodiment the magnet(s) and/or the metal piece or pieces are mounted on a lower surface 93 of the pump coupler and un upper surface 95 of the base portion 88 of the motor coupler. With such an embodiment, the motor coupler may not need the tubular portion 86.

In one exemplary embodiment, the motor 80 is operated by a battery (not shown) or by any electrical, or other type of power source. A controller (not shown) may be incorporated to control the motor based on a signal it receives from the sensor. In some exemplary embodiments the controller is incorporated in the motor. Once the motor 80, or the controller controlling the motor, receives a signal sent from sensor 36 through the circuitry 40 or wirelessly, the motor 80 drives the motor shaft 84 thereby making the motor coupler 82 that is connected to the motor shaft 84 to rotate as well. As the motor coupler 82 rotates, it rotates the pump coupler 60 via the magnetic coupling which cause the pump 58 to pump the liquid soap to the spout outlet 27 via tubing 76. It should be noted that in the exemplary embodiments where the signal from the sensor is transmitted wirelessly the circuitry 40 is not required. The motor 80 may be a stepper motor that is programmed to deliver to one pump or a plurality of pumps of liquid soap. In other words, every time a signal is received from the sensor, the motor operates for a sufficient time to cause the pump to provide a predetermined amount of liquid soap to the spout outlet. Alternatively, the motor 80 or the controller may be programmed to cause the motor to operate and deliver the liquid soap for a period of time. Depending on the type of motor and program logic, the soap may dispensed in discrete amounts through an outlet 27 of the spout to the user's hand.

By being removably coupled, e.g., threaded to the reservoir body, the base portion may be easily removed to allow for easy access to the pump. A seal may be incorporated at the interface between the base portion and the reservoir body to prevent leakage through the interface between the reservoir body and the base portion.

In another exemplary embodiment, the base portion 22 may be integrally formed with the reservoir body 12 to form the reservoir 24. In other words, the base portion is not a separate piece that this threaded or otherwise coupled to the reservoir body.

The base portion 22 and/or the reservoir body 12 may be made of a plastic material such as propylene or high density polyethylene. In another exemplary embodiment, the base portion 22 may be made of a rigid plastic material that may incorporate a fluoropolymer.

Figure 4:
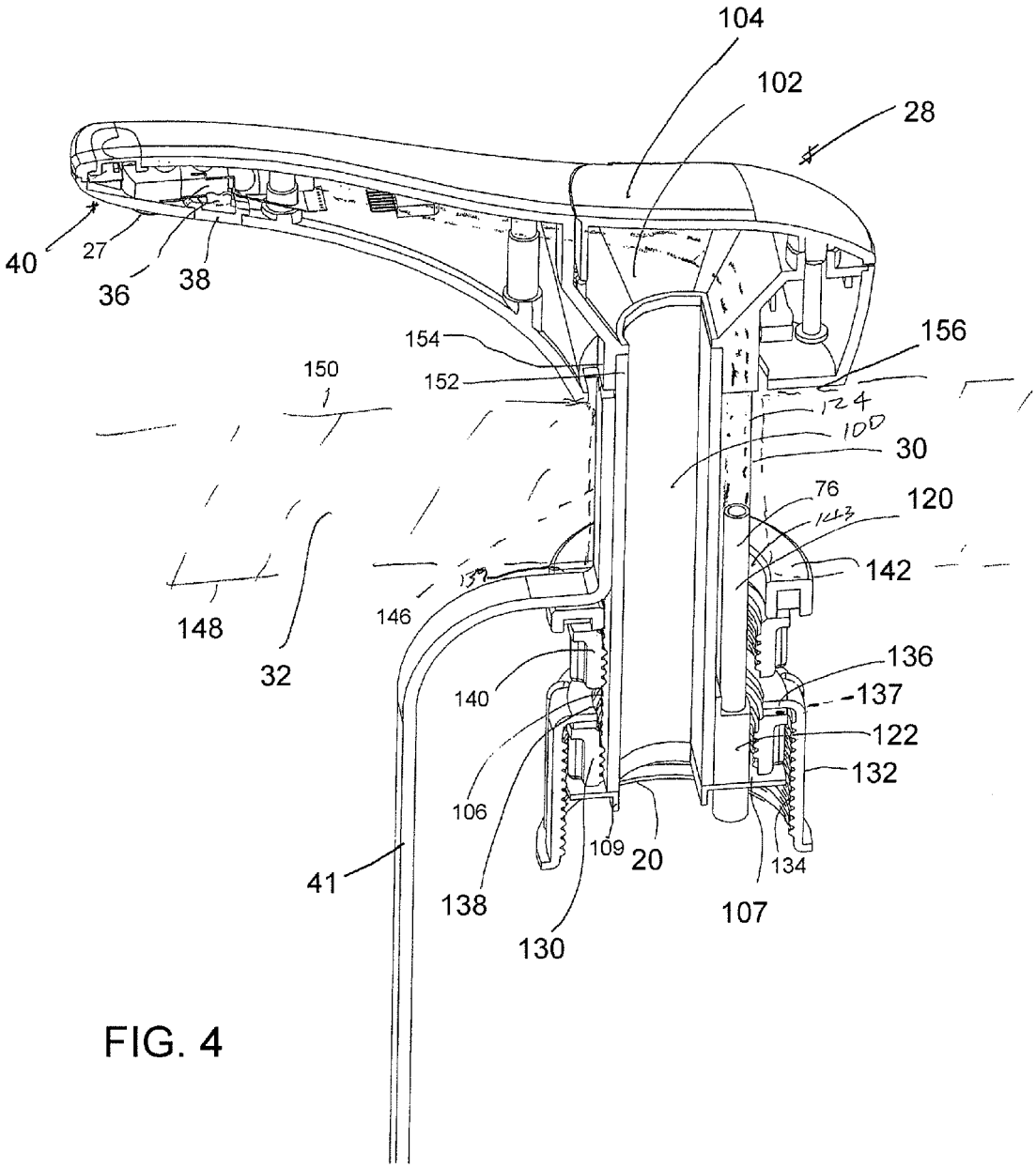
FIG. 4 is a partial cross-sectional view depicting a neck and spout incorporated in the exemplary embodiment automated fluid dispenser shown in FIG. 1.

Referring to FIG. 4, in an exemplary embodiment, a conduit 100 is defined within the neck 30 that extends from a funnel 102 formed, or otherwise positioned, in the spout 28 to the opening 20 formed on the neck 16 of the reservoir body. A lid 104 coupled to the spout 28 provides access to the funnel. The lid may be hingedly coupled to the spout or may be completely removable from the spout. In the shown exemplary embodiment, the lid forms an outer surface of the spout.

The conduit 100 communicates with the reservoir body 12 though the reservoir neck opening 20. In this regard, the dispenser may be refilled with liquid soap by opening the lid and pouring the liquid soap through the funnel. As such, the dispenser does not have to be removed from the countertop in order to be refilled. In other exemplary embodiments, the conduit may extend to a location proximate the lid without incorporating a funnel. However, a funnel is desired as it will facilitate the pouring of the liquid into the conduit while minimizing or alleviating over-spilling it in the areas surrounding the conduit.

In the shown exemplary embodiment, the neck 30 is a separate member that is attachable to the reservoir body 12. In the exemplary embodiment shown in FIGS. 1, 2 and 4, the neck has a threaded outer surface 106. A flange 107, and preferably a gasket flange 107, extends from a bottom end portion of the neck. A lip 109 extends axially below the flange 107. The reservoir body neck section 16 also has a threaded outer surface 108 (FIG. 2). A shoulder 110 is defined on the reservoir neck adjacent the opening 20. Another opening 112 is formed through the shoulder for accommodating the tubing for delivering the liquid soap to the spout outlet. In the exemplary embodiment shown in FIG. 2, a male tubing connector 114 is coupled to the opening 112. In the shown exemplary embodiment, the opening 112 is bounded by a tapering inner surface 117 such that the diameter of the opening decreases in a direction toward the reservoir. With this exemplary embodiment the tubing 76 has at least two sections, a first section 118 and a second section 120. The male tubing connector has a tapering outer surface portion 116 for engaging and exerting a force against an inner surface of a first section 118 of the tubing 76 to which it is connected. In other words, the tapering outer surface tapers from a larger diameter to smaller diameter in a direction toward the tip of the connector. The smaller diameter is smaller than the inner surface diameter of the first section 118 of tubing 76 while the larger diameter is larger than the inner surface diameter of the first section 118 of tubing 76. A connector 122 is coupled to an end of the second section 120 of the tubing (FIG. 4). The connector in the shown exemplary embodiment is a cylindrical connector which has an outer diameter that is greater than a smaller diameter of the inner surface 117 of the opening 112 and smaller than the largest diameter of the inner surface 117 of the opening 112. In this regard as the connector 122 is fitted into the opening 112 lodges against the inner surface as it is pushed inward toward the reservoir forming a friction connection. In an exemplary embodiment, the connector 122 is more rigid than the tubing second section 120 such that it remains rigid, i.e. does not bend, as it is pushed into the opening 112. In another exemplary embodiment, a connector 122 is not used and the tubing second section 120 is directly inserted into the opening 112. With this exemplary embodiment, the tubing second section 120 outer diameter is greater than a smaller diameter of the inner surface 117 of the opening 112 and smaller than the largest diameter of the inner surface 117 of the opening 112 so as to be able to form a friction connection with the inner surface 117 of the opening 112. A groove 124 is formed longitudinally along the neck 30 outer surface as shown in FIG. 4 to accommodate a portion of the second section 120 of the tubing 76. The tubing second section 120 portion is fitted into the groove.

A first lock nut 130 is threaded on the threaded outer surface 106 of the neck and is external of the groove 124 and tubing second section 120. In other words it surrounds the tubing second section 120. A reservoir cap 132, having a threaded inner surface 134, and having a top section 136 having an opening 138 wide enough to be penetrated by the neck, is fitted over the neck and slid down until a top section 136 of the cap engages the first lock nut 130. A retaining washer 137 which is limited in axial travel, sits on axial nut 130 and thus limits the axial travel available to lock nut 130. Thus, the location at which the cap engages the first lock nut can be adjusted by how far along the neck the first lock nut is threaded. In an exemplary embodiment, the first lock nut 130 may be threaded far enough down onto the neck until it sits on the flange 107.

A second lock nut 140 is threaded on the threaded outer surface 106 of the neck above the first lock nut and the cap so as to surround the groove 124 and second tubing section 120. An annular flange 142 may then be slid over the neck 30 on top of the second lock nut. The annular flange 142 has an inner opening that is penetrated by the neck. The diameter of the opening is smaller than an outer surface diameter of the second lock nut, such that it is axially engageable by the second lock nut. The flange opening diameter is greater than the outer surface diameter of the neck 30. In the shown exemplary embodiment, the annular flange includes a radial groove 139 (FIGS. 1 and 4) to accommodate the flexible circuit 41.

In another exemplary embodiment, the spout 28 may be connected or may be integral with the neck 30. With this exemplary embodiment, the annular flange 142 is mounted over the neck through the bottom of the neck, followed by the second lock nut 140, the reservoir cap 132, the retainer washer 137, the first lock nut 130 and the flange 107.

To connect the neck 30 to the reservoir body 12, the neck flange 107 is seated on the shoulder 110 formed on the reservoir neck such that the lip 109 extending from the neck extends into the opening 20 formed on the reservoir neck and the connector 122 when used (or the tubing second section 120 when a connector 122 is not used) is seated in the opening 112. The cap 132 is then threaded on the outer surface threads 108 of the reservoir neck so as to exert an axial force on the first lock nut which exerts an axial force on the neck for retaining the neck connected to the reservoir body. Other known means of coupling the cap to the reservoir body may also be used in lieu of threading.

To disconnect the reservoir body from the neck, the cap is unthreaded or otherwise decoupled from the reservoir body and the reservoir body is removed. When that occurs, the connector 120 (or the tubing second section 120 when a connector 122 is not used) would separate from the reservoir neck.

To connect the dispenser to a countertop, the countertop is formed with a hole 146 having a diameter large enough to receive the neck 30 but smaller than the outer diameter of the flange 142. In an exemplary embodiment, the neck with or without the attached reservoir is fitted from a bottom surface 148 of the counter and through the opening 146, thus protruding through a top surface 150 of the counter. The spout is then connected to the neck. In the shown exemplary embodiment, the spout may be designed such that it can be snap fitted onto the neck. For example, the neck has an upper portion 152 which snap fits into a lower portion of the funnel 102 (FIG. 4). The second lock nut is then threaded onto the neck so as to move in an upward direction sandwiching the countertop 32 between the flange 142 and the lower surface 156 of the neck, thereby clamping the dispenser onto the countertop. By having an opening 143 that is larger than the outer surface diameter of the neck, when the second lock nut is threaded upwards on the neck, the annual flange 142 is retained in position and does not rotate by the flexible circuit 41 which is fitted in groove 139.

In another exemplary embodiment, the spout 28 may come pre-connected or integrally formed with a neck 30. With this exemplary embodiment, the neck without the attached reservoir is fitted from a top surface 150 of the counter and through the bottom surface 148 of the counter. The reservoir is then connected to the neck, as described herein, from below the bottom surface 148 of the counter.

Although the present invention has been described and illustrated to respect to multiple embodiments thereof, it is to be understood that it is not to be so limited, since changes and modifications may be made therein which are within the full intended scope of this invention as hereinafter claimed.

What is claimed is:

1. A fluid dispenser comprising:

a reservoir for storing the fluid to be dispensed;

an outlet for dispensing the fluid there-through;

a pump in the reservoir for pumping the fluid to the outlet;

a motor external of the reservoir;

a coupling magnetically transferring a force generated by the motor to the pump for operating the pump for pumping said fluid;

a neck extending from the reservoir defining a conduit in communication with said reservoir;

a spout extending from the neck comprising a lid and said outlet, wherein the lid is moveable for providing access to said conduit, and wherein said reservoir is fillable through said conduit; and a funnel in the spout and coupled to said conduit, wherein said funnel is covered by said lid.

2. The dispenser as recited in claim 1 further comprising a sensor proximate the outlet for sensing movement proximate the outlet and for generating a signal in response thereto, wherein said pump pumps fluid in response to said signal.

3. The dispenser as recited in claim 2 wherein said motor is operable in response to said signal.

4. The dispenser as recited in claim 1 wherein the neck comprises a threaded outer surface, the dispenser further comprising a cap threaded to the reservoir and coupling the neck to the reservoir.

5. The dispenser as recited in claim 4 further comprising a lock nut threaded on the outer surface of the neck, wherein the cap comprises a first surface and a second annular surface extending from the first surface, wherein an opening is formed through the first surface, wherein the neck penetrates said opening and the first surface urges said lock nut toward said reservoir.

6. The dispenser as recited in claim 1 wherein the neck has a threaded outer surface, the dispenser further comprising:

a groove formed along the neck;

a first conduit coupled to the pump;

a second conduit extending to the outlet, wherein at least part of the second conduit is received in the groove;

a conduit connector coupled to the neck and releasably connecting the first conduit to the second conduit;

a first nut threaded on the outer surface of the neck and surrounding said portion of the second conduit received in the groove;

a cap having an opening penetrated by the neck and threaded to the reservoir, wherein the cap is retained in an axial direction by the first nut; and a second nut threaded on the outer surface of the neck and surrounding said portion of the second conduit received in the groove.

7. The dispenser as recited in claim 1 wherein said fluid is a liquid soap.

8. The dispenser as recited in claim 1 wherein the lid defines an upper surface of the spout.

9. The dispenser as recited in claim 1 wherein the dispenser is mounted on a surface and wherein the spout is above the surface, the reservoir is below the surface, and the neck penetrates the surface.

10. A fluid dispenser comprising:

a reservoir;

a neck extending from the reservoir having a threaded outer surface;

a groove formed along the neck;

a spout extending from the neck, wherein the outlet is formed on the spout;

a pump for pumping fluid from the reservoir to the outlet;

a first conduit coupled to the pump;

a second conduit extending to the outlet, wherein at least part of the second conduit is received in the groove;

a conduit connector coupled to the neck and releasably connecting the first conduit to the second conduit;

a first nut threaded on the outer surface of the neck and surrounding said portion of the second conduit received in the groove;

a cap having an opening penetrated by the neck and threaded to the reservoir, wherein the cap is retained in an axial direction by the first nut; and a second nut threaded on the outer surface of the neck and surrounding said portion of the second conduit received in the groove.

11. The dispenser as recited in claim 10 wherein a third conduit is defined through the neck, the spout further comprising a lid, said lid being moveable for providing access to said third conduit for filling said reservoir.

12. The dispenser as recited in claim 11 further comprising a funnel in said spout and coupled to said third conduit, wherein said lid is moveable for providing access to said funnel for filling said reservoir.

13. The dispenser as recited in claim 10 wherein said fluid is a liquid soap.

14. A fluid dispenser comprising:

a reservoir;

a neck extending from the reservoir defining a conduit there-through leading to said reservoir; and a spout extending from the neck, said spout comprising a lid and an outlet, wherein the lid is moveable for providing access to said conduit for filling said reservoir with a fluid, wherein the dispenser is mounted to a surface and wherein the spout is above the surface, the reservoir is below the surface, and the neck penetrates the surface.

15. The dispenser as recited in claim 14 further comprising a funnel in said spout and coupled to said conduit, wherein said lid is moveable for providing access to said funnel for filling said reservoir.

16. The dispenser as recited in claim 14 wherein said fluid is a liquid soap.

17. The dispenser as recited in claim 14 wherein the lid defines an upper surface of the spout.

18. The dispenser as recited in claim 14 wherein the lid is removable.

19. A fluid dispenser comprising:

a reservoir for storing the fluid to be dispensed;

an outlet for dispensing the fluid there-through;

a pump in the reservoir for pumping the fluid to the outlet;

a motor external of the reservoir;

a coupling magnetically transferring a force generated by the motor to the pump for operating the pump for pumping said fluid;

a neck extending from the reservoir defining a conduit in communication with said reservoir;

a spout extending from the neck comprising a lid and said outlet, wherein the lid is moveable for providing access to said conduit, and wherein said reservoir is fillable through said conduit, wherein the neck comprises a threaded outer surface;

a cap threaded to the reservoir and coupling the neck to the reservoir; and a lock nut threaded on the outer surface of the neck, wherein the cap comprises a first surface and a second annular surface extending from the first surface, wherein an opening is formed through the first surface, wherein the neck penetrates said opening and the first surface urges said lock nut toward said reservoir.

20. A fluid dispenser comprising:

a reservoir for storing the fluid to be dispensed;

an outlet for dispensing the fluid there-through;

a pump in the reservoir for pumping the fluid to the outlet;

a motor external of the reservoir;

a coupling magnetically transferring a force generated by the motor to the pump for operating the pump for pumping said fluid;

a neck extending from the reservoir defining a conduit in communication with said reservoir, wherein the neck has a threaded outer surface;

a spout extending from the neck comprising a lid and said outlet, wherein the lid is moveable for providing access to said conduit, and wherein said reservoir is finable through said conduit;

a groove formed along the neck;

a first conduit coupled to the pump;

a second conduit extending to the outlet, wherein at least part of the second conduit is received in the groove;

a conduit connector coupled to the neck and releasably connecting the first conduit to the second conduit;

a first nut threaded on the outer surface of the neck and surrounding said portion of the second conduit received in the groove;

a cap having an opening penetrated by the neck and threaded to the reservoir, wherein the cap is retained in an axial direction by the first nut; and a second nut threaded on the outer surface of the neck and surrounding said portion of the second conduit received in the groove.

21. A fluid dispenser comprising:

a reservoir for storing the fluid to be dispensed;

an outlet for dispensing the fluid there-through;

a pump in said reservoir for pumping the fluid to the outlet;

a neck extending from the reservoir defining a conduit in communication with said reservoir; and a spout extending from the neck comprising a lid defining a surface of said spout, wherein the lid is moveable for providing access to said conduit, and wherein said reservoir is fillable through said conduit.

22. The dispenser as recited in claim 21 wherein the pump is in the reservoir, the dispenser further comprising:

a motor external of the reservoir; and a coupling magnetically transferring a force generated by the motor to the pump for operating the pump for pumping said fluid.

23. The dispenser as recited in claim 22 further comprising a sensor proximate the outlet for sensing movement proximate the outlet and for generating a signal in response thereto, wherein said pump pumps fluid in response to said signal.

24. The dispenser as recited in claim 23 wherein said motor is operable in response to said signal.

25. The dispenser as recited in claim 24 further comprising a funnel in the spout and coupled to said conduit, wherein said funnel is covered by said lid.

26. The dispenser as recited in claim 21 further comprising a funnel in the spout and coupled to said conduit, wherein said funnel is covered by said lid.

27. The dispenser as recited in claim 21 wherein the neck comprises a threaded outer surface, the dispenser further comprising a cap threaded to the reservoir and coupling the neck to the reservoir.

28. The dispenser as recited in claim 27 further comprising a lock nut threaded on the outer surface of the neck, wherein the cap comprises a first surface and a second annular surface extending from the first surface, wherein an opening is formed through the first surface, wherein the neck penetrates said opening and the first surface urges said lock nut toward said reservoir.

29. The dispenser as recited in claim 21 wherein the neck has a threaded outer surface, the dispenser further comprising:

a groove formed along the neck;

a first conduit coupled to the pump;

a second conduit extending to the outlet, wherein at least part of the second conduit is received in the groove;

a conduit connector coupled to the neck and releasably connecting the first conduit to the second conduit;

a first nut threaded on the outer surface of the neck and surrounding said portion of the second conduit received in the groove;

a cap having an opening penetrated by the neck and threaded to the reservoir, wherein the cap is retained in an axial direction by the first nut; and a second nut threaded on the outer surface of the neck and surrounding said portion of the second conduit received in the groove.

30. A fluid dispenser comprising:

a reservoir for storing the fluid to be dispensed;

an outlet for dispensing the fluid there-through;

a pump in said reservoir for pumping the fluid to the outlet;

a neck extending from the reservoir defining a conduit in communication with said reservoir;

a spout extending from the neck comprising a lid and said outlet, wherein the lid is moveable for providing access to said conduit, and wherein said reservoir is fillable through said conduit; and a funnel in the spout and coupled to said conduit, wherein said funnel is covered by said lid.

31. A fluid dispenser comprising:

a reservoir;

a spout coupled to said reservoir, said spout comprising an inlet in communication with said reservoir for filling said reservoir with a fluid through said inlet, and an outlet for dispensing said fluid there-through;

a pump in said reservoir for pumping said fluid to be dispensed through said outlet;

a neck coupling the reservoir to the spout, the neck extending from the reservoir defining a conduit there-through leading to said reservoir; and a funnel in communication with said inlet and said conduit for receiving fluid from said inlet.

32. The dispenser as recited in claim 31 further comprising a lid covering said inlet and said funnel.

33. A fluid dispenser comprising:

a reservoir;

a spout coupled to said reservoir said spout comprising an inlet in communication with said reservoir for filling said reservoir with a fluid through said inlet, and an outlet for dispensing said fluid there-through;

a pump in said reservoir for pumping said fluid to be dispensed through said outlet; and a lid for covering said inlet.

34. A fluid dispenser comprising:

a reservoir;

a pump in the reservoir for pumping said fluid;

a neck extending from the reservoir defining a conduit there-through leading to said reservoir; and a spout extending from the neck, said spout comprising a lid, and an outlet for receiving fluid pumped by said pump, wherein the lid is moveable for providing access to said conduit for filling said reservoir with a fluid.

35. The dispenser as recited in claim 34 further comprising a funnel in said spout and coupled to said conduit, wherein said lid is moveable for providing access to said funnel for filling said reservoir.

36. The dispenser as recited in claim 34 wherein said fluid is a liquid soap.

37. The dispenser as recited in claim 34 wherein the lid defines an upper surface of the spout.

38. The dispenser as recited in claim 34 wherein the dispenser is mounted on a surface and wherein the spout is above the surface, the reservoir is below the surface, and the neck penetrates the surface.

39. The dispenser as recited in claim 34 wherein the lid is removable.

40. A fluid dispenser comprising:

a reservoir for storing the fluid to be dispensed;

an outlet for dispensing the fluid there-through;

a pump in said reservoir for pumping the fluid to the outlet;

a neck extending from the reservoir defining a conduit in communication with said reservoir;

a spout extending from the neck comprising a lid defining a surface of said spout, wherein the lid is moveable for providing access to said conduit, and wherein said reservoir is fillable through said conduit;

a motor external of the reservoir; and a coupling magnetically transferring a force generated by the motor to the pump for operating the pump for pumping said fluid.

41. The dispenser as recited in claim 40 further comprising a sensor proximate the outlet for sensing movement proximate the outlet and for generating a signal in response thereto, wherein said pump pumps fluid in response to said signal.

42. The dispenser as recited in claim 41 wherein said motor is operable in response to said signal.

43. The dispenser as recited in claim 42 further comprising a funnel in the spout and coupled to said conduit, wherein said funnel is covered by said lid.

44. The dispenser as recited in claim 40 further comprising a funnel in the spout and coupled to said conduit, wherein said funnel is covered by said lid.

45. A fluid dispenser comprising:

a reservoir for storing the fluid to be dispensed;

an outlet for dispensing the fluid there-through;

a pump for pumping the fluid to the outlet;

a neck extending from the reservoir defining a conduit in communication with said reservoir, the neck comprising a threaded outer surface;

a cap threaded to the reservoir and coupling the neck to the reservoir; and a spout extending from the neck comprising a lid defining a surface of said spout, wherein the lid is moveable for providing access to said conduit, and wherein said reservoir is finable through said conduit.

46. The dispenser as recited in claim 45 further comprising a lock nut threaded on the outer surface of the neck, wherein the cap comprises a first surface and a second annular surface extending from the first surface, wherein an opening is formed through the first surface, wherein the neck penetrates said opening and the first surface urges said lock nut toward said reservoir.

47. The dispenser as recited in claim 45 further comprising a funnel in the spout and coupled to said conduit, wherein said funnel is covered by said lid.

* * * * *

UNITED STATES PATENT AND TRADEMARK OFFICE

CERTIFICATE OF CORRECTION

PATENT NO. : 8,579,157 B2
APPLICATION NO. : 12/605258
DATED : November 12, 2013
INVENTOR(S) : Branko Bem et al.

It is certified that error appears in the above-identified patent and that said Letters Patent is hereby corrected as shown below:

In the Claims

| | |
|---|---|
| Column 11, Claim 20, line 3 | Delete "finable"<br>Insert -- fillable -- |
| Column 14, Claim 45, line 16 | Delete "finable"<br>Insert -- fillable -- |

Signed and Sealed this
Twentieth Day of January, 2015

Michelle K. Lee

Michelle K. Lee
*Deputy Director of the United States Patent and Trademark Office*